US006846782B2

(12) United States Patent
Calder

(10) Patent No.: US 6,846,782 B2
(45) Date of Patent: Jan. 25, 2005

(54) METHOD OF REDUCING INTAKE VALVE DEPOSITS IN A DIRECT INJECTION ENGINE

(75) Inventor: Raymond M. Calder, Allestree (GB)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 10/407,983

(22) Filed: Apr. 4, 2003

(65) Prior Publication Data

US 2004/0198614 A1 Oct. 7, 2004

(51) Int. Cl.[7] ..... C10M 111/02

(52) U.S. Cl. ..... 508/293; 508/433; 508/482; 508/485; 508/496; 508/542; 508/591

(58) Field of Search ..... 508/591, 293

(56) References Cited

U.S. PATENT DOCUMENTS

| | | | | | |
|---|---|---|---|---|---|
| 5,652,204 | A | | 7/1997 | Cracknell et al. | 508/562 |
| 6,060,437 | A | * | 5/2000 | Robson et al. | 508/371 |
| 6,232,279 | B1 | * | 5/2001 | Steigerwald | 508/591 |
| 6,235,691 | B1 | | 5/2001 | Boffa et al. | 508/482 |
| 6,331,510 | B1 | | 12/2001 | Curtis et al. | 508/578 |
| 6,444,624 | B1 | * | 9/2002 | Walker et al. | 508/363 |
| 6,475,251 | B1 | * | 11/2002 | Ahmadi | 44/387 |
| 6,583,092 | B1 | * | 6/2003 | Carrick et al. | 508/198 |
| 6,586,374 | B1 | * | 7/2003 | Paul | 508/214 |
| 6,649,576 | B2 | * | 11/2003 | Bell et al. | 508/481 |

FOREIGN PATENT DOCUMENTS

| | | |
|---|---|---|
| EP | 0 648 830 A2 | 4/1995 |
| WO | 96/15210 | 5/1996 |
| WO | 99/18175 | 4/1999 |

OTHER PUBLICATIONS

SAE Technical Paper 1999–01–1498, Arters et al., May, 1999, "A Comparison of Gasoline Direct–Injection and Port Fuel Injection Vehicles; Part 1".

Internet site http//www.mitsubishi–motors.co.jp/inter/technology/GDIEC/gdi_ov/5p.html, accessed May 3, 2002, "The Ultimate Engine—The GDI Engine".

Internet site http://www.mitsubishi–motors.co.jp/GDI2000/p01.htm, (p. 1), p02.htm , (p. 2), /p06.htm, (p. 6), and p11.htm (p. 11), accessed May 3, 2002, GDI, "Gasoline Direct Injection".

Internet site http://www.mitsubishi–motors.co.jp/inter/entrance.html, and /inter/technology/technology.html, accessed May 3, 2002, "Mitsubishi Motors".

International Search Report and Written Opinion, Application No. PCT/US2004/005073, dated Jul. 6, 2004.

Mackney et al.; "Reducing Deposits in a DISI Engine"; Society of Automotive Engineers, Inc.; SAE Technical Paper Series, No. 2002–01–2660; Oct. 21, 2002, XP002286798.

* cited by examiner

*Primary Examiner*—Ellen M. McAvoy
(74) *Attorney, Agent, or Firm*—David M. Shold; Michael F. Esposito

(57) ABSTRACT

This invention relates to a method of reducing intake valve deposits in a direct injection engine, the method comprising lubricating the engine with a lubricating oil composition comprising a base oil mixture, the base oil mixture comprising (i) a Group III, a Group IV oil, or a mixture thereof, in combination with (ii) a synthetic ester oil, the weight ratio of (i) to (ii) being from about 0.2:1 to about 6:1.

28 Claims, No Drawings

METHOD OF REDUCING INTAKE VALVE DEPOSITS IN A DIRECT INJECTION ENGINE

TECHNICAL FIELD

This invention relates to a method of reducing intake valve deposits in a direct injection engine.

BACKGROUND OF THE INVENTION

Direct injection engines are engines wherein fuel injection occurs inside the engine's cylinders. The fact that the fuel is injected directly into the cylinders enables precise control over the amount of fuel burned and the timing of injection. However, a problem with these engines is that intake valve deposits tend to build up to unacceptable levels. These deposits interfere with valve closing, valve motion and valve sealing. They reduce the efficiency of the engine and limit maximum power. The present invention provides a solution to this problem.

SUMMARY OF THE INVENTION

This invention relates to a method of reducing intake valve deposits in a direct injection engine, the method comprising lubricating the engine with a lubricating oil composition comprising a base oil mixture, the base oil mixture comprising (i) a Group III oil, a Group IV oil or a mixture thereof, in combination with (ii) a synthetic ester oil, the weight ratio of (i) to (ii) being from about 0.2:1 to about 6:1.

DETAILED DESCRIPTION OF THE INVENTION

The terms "hydrocarbyl" and "hydrocarbon," when referring to groups attached to the remainder of a molecule, refers to groups having a purely hydrocarbon or predominantly hydrocarbon character within the context of this invention. Such groups include the following:

(1) Purely hydrocarbon groups; that is, aliphatic, alicyclic, aromatic, aliphatic- and alicyclic-substituted aromatic, aromatic-substituted aliphatic and alicyclic groups, and the like, as well as cyclic groups wherein the ring is completed through another portion of the molecule (that is, any two indicated substituents may together form an alicyclic group). Examples include methyl, octyl, cyclohexyl, phenyl, etc.

(2) Substituted hydrocarbon groups; that is, groups containing non-hydrocarbon substituents which do not alter the predominantly hydrocarbon character of the group. Examples include hydroxy, nitro, cyano, alkoxy, acyl, etc.

(3) Hetero groups; that is, groups which, while predominantly hydrocarbon in character, contain atoms other than carbon in a chain or ring otherwise composed of carbon atoms. Examples include nitrogen, oxygen and sulfur.

In general, no more than about three substituents or hetero atoms, and in one embodiment no more than one, will be present for each 10 carbon atoms in the hydrocarbyl group.

The term "lower" as used herein in conjunction with terms such as hydrocarbyl, alkyl, alkenyl, alkoxy, and the like, is intended to describe such groups which contain a total of up to 7 carbon atoms.

The term "oil-soluble" refers to a material that is soluble in mineral oil to the extent of at least about 0.5 gram per liter at 25° C.

The term "TBN" refers to total base number. This is the amount of acid (perchloric or hydrochloric) needed to neutralize all or part of a material's basicity, expressed as milligrams of KOH per gram of sample.

The term "TAN" refers to total acid number. This is the amount of base (NaOH or KOH) needed to neutralize all or part of a material's acidity, expressed as milligrams of KOH per gram of sample.

The Direct Injection Engine

The direct injection engine may be a spark ignition or a compression ignition engine. These engines may be automobile or truck engines, two-cycle engines, aviation piston engines, marine or railroad diesel engines, and the like. Included are on- and off-highway engines. The compression ignition engines may include those for both mobile and stationary power plants. The compression ignition engines may include those used in urban buses, as well as all classes of trucks. The compression ignition engines may be of the two-stroke per cycle or four-stroke per cycle type. The compression ignition engines may include heavy duty diesel engines.

The Lubricating Oil Composition.

The lubricating oil composition used in accordance with the inventive method comprises a base oil mixture which is generally present in a major amount based on the overall weight of the lubricating oil composition. The base oil mixture may be present in an amount greater than about 50%, and in one embodiment greater than about 60%, and in one embodiment greater than about 70% by weight of the lubricating oil composition. The lubricating oil composition may further comprise: an acylated-nitrogen containing compound which typically functions as a dispersant; a Mannich condensate which typically functions as a dispersant; an alkali or alkaline earth metal containing salt which typically functions as a detergent; and/or a metal salt of a phosphorus-containing compound which typically functions as an anti-wear or extreme pressure (EP) additive. The lubricating oil composition may further comprise other additives known in the art.

The lubricating oil composition may have a viscosity of up to about 16.3 cSt at 100° C., and in one embodiment about 5 to about 16.3 cSt at 100° C., and in one embodiment about 6 to about 13 cSt at 100° C.

The lubricating oil composition may have an SAE Viscosity Grade of 5, 10, 20, 30, 40, 50, 60, 0W-20, 0W-30, 0W-40, 0W-50, 0W-60, 5W-20, 5W-30, 5W-40, 5W-50, 5W-60, 10W-20, 10W-30, 10W-40, 10W-50, 15W-20, 15W-30, 15W-40, 15W-50, 20W-20, 20W-30, 20W-40 or 20W-50.

The lubricating oil composition may be characterized by a sulfur content of up to about 1% by weight, and in one embodiment up to about 0.5% by weight.

The lubricating oil composition may be characterized by a phosphorus content of up to about 0.14% by weight, and in one embodiment up to about 0.12% by weight, and in one embodiment about 0.03 to about 0.12% by weight, and in one embodiment about 0.03 to about 0.10% by weight, and in one embodiment about 0.03 to about 0.08% by weight, and in one embodiment about 0.03 to about 0.05% by weight.

The ash content of the lubricating oil composition as determined by the procedures in ASTM D-874-96 may be in the range of up to about 1.5% by weight, and in one embodiment about 0.3 to about 1.4% by weight, and in one embodiment about 0.3 to about 1.2% by weight, and in one embodiment about 0.3 to about 1.0% by weight.

The lubricating oil composition may be characterized by a chlorine content of up to about 100 ppm, and in one embodiment up to about 50 ppm, and in one embodiment up to about 10 ppm.

The Base Oil Mixture

The base oil mixture comprises (i) a Group III oil, a Group IV oil, or a mixture thereof, in combination with (ii) a synthetic ester oil. The weight ratio of the oil component (i) to the oil component (ii) may range from about 0.2:1 to about 6:1, and in one embodiment about 0.2:1 to about 5:1, and in one embodiment about 0.3:1 to about 4:1, and in one embodiment about 0.4:1 to about 3.5:1. In one embodiment, the ratio is from about 2.5:1 to about 3.5:1, and in one embodiment from about 2.8:1 to about 3.2:1. In one embodiment, the ratio is from about 0.3:1 to about 0.6:1, and in one embodiment about 0.4:1 to about 0.5:1.

The Group III oils and the Group IV oils are specified in the American Petroleum Institute (API) Base Oil Interchangeability Guidelines. The Group III oils are defined as having the following minimum characteristics: ≦0.03% sulfur, ≧90% saturates, and ≧120 viscosity index. In one embodiment, the saturates content is at least about 95% by weight, and in one embodiment at least about 98% by weight; and the sulfur content is up to about 0.02% by weight, and in one embodiment up to about 0.01% by weight. These oils are typically derived from natural stocks (as opposed to being derived from synthetic sources), but are so highly refined that they may exhibit the performance and viscosity parameters of other synthetic base oils.

The Group IV oils are defined as polyalphaolefin oils. The polyalphaolefins (PAO) may be derived from monomers having from about 4 to about 30 carbon atoms, and in one embodiment from about 4 to about 20 carbon atoms, and in one embodiment from about 6 to about 16 carbon atoms. Examples of useful PAOs include those derived from octene, decene, mixtures thereof, and the like. These PAOs may have a viscosity from about 2 to about 15 cSt at 100° C., and in one embodiment from about 3 to about 12, and in one embodiment from about 4 to about 8 cSt at 100° C., and in one embodiment about 4 to about 6 cSt at 100° C. Examples of useful PAOs include those PAOs having a viscosity of 4 cSt at 100° C., those having a viscosity of 6 cSt at 100° C., and mixtures thereof.

The synthetic ester oils may be the esters of monocarboxylic or dicarboxylic acids with a variety of alcohols or polyols The monocarboxylic and dicarboxylic acids may contain up to about 40 carbon atoms, and in one embodiment about 5 to about 30 carbon atoms, and in one embodiment about 5 to about 20 carbon atoms, and in one embodiment about 8 to about 10 carbon atoms. Examples of monocarboxylic acids that may be used include octanoic acid, 2-ethylhexanoic acid, neopentanoic acid, neodecanoic acid, isodecanoic acid, decanoic acid, tridecanoic acid, pentanoic acid, hexanoic acid, isoheptanoic acid, dodecanoic acid, 3,5,5-trimethyl hexanoic acid, and the like. Examples of dicarboxylic acids that may be used include phthalic acid, succinic acid, alkyl succinic acids, alkenyl succinic acids, maleic acid, azelaic acid, suberic acid, sebacic acid, fumaric acid, adipic acid, linoleic acid dimer, malonic acid, alkyl malonic acids, alkenyl malonic acids, mixtures of two or more thereof, and the like.

The alcohols and polyols which may be used in making the synthetic ester oils include mono- and a polyhydric hydrocarbon-based alcohols such as methanol, ethanol, the propanols, butanols, pentanols, hexanols, heptanols, octanols, decanols, and the like. Also included are fatty alcohols and mixtures thereof, including saturated alcohols such as lauryl, myristyl, cetyl, stearyl and behenyl alcohols, and unsaturated alcohols such as palmitoleyl, oleyl and eicosenyl. Higher synthetic monohydric alcohols of the type formed by the Oxo process (e.g., 2-ethylhexanol), by the aldol condensation, or by organoaluminum-catalyzed oligomerization of alpha-olefins (e.g., ethylene), followed by oxidation, may be used. Alicyclic analogs of the above-described alcohols may be used; examples include cyclopentanol, cyclohexanol, cyclododecanol, and the like.

The polyols that may be used include ethylene, propylene, butylene, pentylene, hexylene and heptylene glycols; tri-, tetra-, penta-, hexa- and heptamethylene glycols and hydrocarbon-substituted analogs thereof (e.g., 2-ethyl-1,3-trimethylene glycol, neopentyl glycol, etc.), as well as polyoxyalkylene compounds such as diethylene and higher polyethylene glycols, tripropylene glycol, dibutylene glycol, dipentylene glycol, dihexylene glycol and diheptylene glycol, and their monoethers.

Phenol, naphthols, substituted phenols (e.g., the cresols), and dihydroxyaromatic compounds (e.g., resorcinol, hydroquinone), as well as a benzyl alcohol and similar di-hydroxy compounds wherein the second hydroxy group is directly bonded to an aromatic carbon (e.g., 3-HO$\phi$CH$_2$OH wherein $\phi$ is a divalent benzene ring) may be used. Sugar alcohols of the general formula $$HOCH_2(CHOH)_{1\text{-}5}CH_2OH$$

such as glycerol, sorbitol, mannitol, etc., and their partial-lyesterified derivatives, and methylol polyols such as pentaerythritol and its oligomers (di- and tripentaerythritol, etc.), trimethylolethane and trimethylolpropane may be used.

Examples of the synthetic ester oils that may be used include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, the complex ester formed by reacting one mole of sebacic acid with two moles of tetraethylene glycol and two moles of 2-ethylhexanoic acid, and the like. The synthetic ester oils include those derived from monocarboxylic acids of about 8 to about 10 carbon atoms and trimethyol propane; and those derived from monocarboxylic acids of about 12 to about 20 carbon atoms, and in one embodiment about 18 carbon atoms, and alcohols of about 12 to about 20 carbon atoms, and in one embodiment about 12 to about 14 carbon atoms.

Commercial synthetic ester oils that may be used include Prolube 1976 and Prolube 3970 supplied by Uniqema.

The Acylated Nitrogen Containing Compound

The acylated nitrogen containing compound may be made by reacting a carboxylic acid acylating agent with an amino compound. The acylating agent may be linked to the amino compound through an imido, amido, amidine or salt linkage. The substituent comprised of at least about 10 aliphatic carbon atoms may be in either the carboxylic acid acylating agent derived portion of the molecule or in the amino compound derived portion of the molecule.

Illustrative substituent goups containing at least about 10 aliphatic carbon atoms include n-decyl, n-dodecyl, tetrapropylene, n-octadecyl, oleyl, chlorooctadecyl, triicontanyl, etc. Generally, these substituents are hydrocarbyl groups made from homo- or interpolymers (e.g., copolymers, terpolymers) of mono- or di-olefins having 2 to about 10 carbon atoms, such as ethylene, propylene, 1-butene, isobutene, butadiene, isoprene, 1-hexene, 1-octene, etc. Typically, these olefins are 1-monoolefins. The substituent may also be derived from the halogenated (e.g., chlorinated or brominated) analogs of such homo- or interpolymers.

A useful source for the substituent groups are poly (isobutene)s obtained by polymerization of a $C_4$ refinery stream having a butene content of about 35 to about 75 weight percent and an isobutene content of about 30 to about 60 weight percent in the presence of a Lewis acid catalyst such as aluminum trichloride or boron trifluoride. These polybutenes contain predominantly isobutene repeating units.

In one embodiment, the substituent is a polyisobutene group derived from a polyisobutene having a high methylvinylidene isomer content. These include the polyisobutenes wherein at least about 50% by weight, and in one embodiment at least about 70% by weight, of the polyisobutenes have methylvinylidene end groups. Suitable polyisobutenes having such high methylvinylidene isomer contents include those prepared using boron trifluoride catalysts.

The acylating agent can vary from formic acid and its acyl derivatives to acylating agents having high molecular weight aliphatic substituents of up to about 5,000, 10,000 or 20,000 carbon atoms. In one embodiment, the acylating agent is a hydrocarbyl substituted succinic acid or anhydride containing hydrocarbyl substituent groups and succinic groups wherein the substituent groups are derived from a polyalkene such as polyisobutene. The acid or anhydride may be characterized by the presence within its structure of an average of at least about 0.6 succinic group for each equivalent weight of substituent groups, and in one embodiment at least about 0.9 succinic group for each equivalent weight of substituent group. In one embodiment, the acid or anhydride may be characterized by the presence within its structure of an average of about 0.6 to about 2.5 succinic groups for each equivalent weight of substituent groups, and in one embodiment about 0.9 to about 2.5 succinic groups for each equivalent weight of substituent groups. In one embodiment, the ratio of succinic groups to equivalent weights of substituent groups is in the range of about 0.6:1 to about 1.8:1, and in one embodiment about 0.9:1 to about 1.8:1, and in one embodiment about 0.6:1 to about 1.5:1, and in one embodiment about 0.9:1 to about 1.5:1. The polyalkene may have a number average molecular weight ($\overline{M}n$) of at least about 700, and in one embodiment about 700 to about 3000, and in one embodiment about 900 to about 2200. The ratio between the weight average molecular weight ($\overline{M}w$) and the ($\overline{M}n$) (that is, $\overline{M}w/\overline{M}n$) may range from about 1 to about 10, and in one embodiment about 1.5 to about 5, and in one embodiment about 2.5 to about 5. For purposes of this invention, the number of equivalent weights of substituent groups is deemed to be the number corresponding to the quotient obtained by dividing the $\overline{M}n$ value of the polyalkene from which the substituent is derived into the total weight of the substituent groups present in the substituted succinic acid or anhydride.

The amino compound may be characterized by the presence within its structure of at least one HN< group and can be a monoamine or polyamine. Mixtures of two or more amino compounds can be used in the reaction with one or more acylating reagents. In one embodiment, the amino compound contains at least one primary amino group (i.e., —$NH_2$). In one embodiment, the amine is a polyamine, for example, a polyamine containing at least two —NH— groups, either or both of which are primary or secondary amines. The amines may be aliphatic, cycloaliphatic, aromatic or heterocyclic amines. Hydroxy substituted amines, such as alkanol amines (e.g., mono- or diethanol amine), and hydroxy (polyhydrocarbyloxy) anologs of such alkanol amines' may be used.

Among the useful amines are the alkylene polyamines, including the polyalkylene polyamines. The alkylene polyamines include those represented by the formula

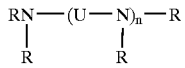

(I)

wherein in Formula (I), n is from 1 to about 14; each R is independently a hydrogen atom, a hydrocarbyl group or a hydroxy-substituted or amine-substituted hydrocarbyl group having up to about 30 atoms, or two R groups on different nitrogen atoms can be joined together to form a U group, with the proviso that at least one R group is a hydrogen atom and U is an alkylene group of about 2 to about 10 carbon atoms. U may be ethylene or propylene. Alkylene polyamines where each R is hydrogen or an amino-substituted hydrocarbyl group with the ethylene polyamines and mixtures of ethylene polyamines are useful. Usually n will have an average value of from about 2 to about 10. Such alkylene polyamines include methylene polyamines, ethylene polyamines, propylene polyamines, butylene polyamines, pentylene polyamines, hexylene polyamines, heptylene polyamines, etc. The higher homologs of such amines and related amino alkyl-substituted piperazines are also included.

Alkylene polyamines that are useful include ethylene diamine, diethylene triamine, triethylene tetramine, tetraethylene pentamine, pentaethylene hexamine, propylene diamine, trimethylene diamine, hexamethylene diamine, decamethylene diamine, octamethylene diamine, di(heptamethylene)triamine, tripropylene tetramine, trimethylene diamine, di(trimethylene)triamine, N-(2-aminoethyl)piperazine, 1,4-bis(2-aminoethyl)piperazine, and the like. Higher homologs such as those obtained by condensing two or more of the above-illustrated alkylene amines may be used. Mixtures of two or more of any of the afore-described polyamines may be used.

Useful polyamines include those resulting from stripping polyamine mixtures. In this instance, lower molecular weight polyamines and volatile contaminants are removed from an alkylene polyamine mixture to leave as residue what is often termed "polyamine bottoms". In general, alkylene polyamine bottoms can be characterized as having less than about 2% by weight, and in one embodiment less than about 1% by weight material boiling below about 200° C.

The acylated nitrogen containing compounds include amine salts, amides, imides, amidines, amidic acids, amidic salts and imidazolines as well as mixtures thereof. To prepare the acylated nitrogen-containing compounds from the acylating agents and the amino compounds, one or more acylating reagents and one or more amino compounds may be heated, optionally in the presence of a normally liquid, substantially inertorganic liquid solvent/diluent, at temperatures in the range of 80° C. up to the decomposition point of any of the reactants or the product but normally at temperatures in the range of about 100° C. to about 300° C., provided 300° C. does not exceed the decomposition point of any of the reactants or the product. Temperatures of about 125° C. to about 250° C. may be used. The acylating agent and the amino compound may be reacted in amounts sufficient to provide from about 0.5 to about 3 moles of amino compound per equivalent of acylating agent. The number of equivalents of the acylating agent will vary with the number of carboxy groups present therein. In determining the number of equivalents of the acylating agent, those carboxyl functions which are not capable of reacting as a carboxylic acid acylating agent are excluded. In general, however, there is one equivalent of acylating agent for each carboxy group in the acylating agent.

In one embodiment, the acylated nitrogen containing compound may be a polyisobutene substituted succinimide derived from a polyisobutene substituted succinic anhydride or acid and a polyamine, and the ratio of C═O from the polyisobutene substituted succinic anhydride or acid to N from the polyamine is up to about 1.18:1, and in one embodiment up to about 1.15:1, and in one embodiment the ratio is up to about 1.1:1.

In one embodiment, the acylated nitrogen containing compound may be a polyisobutene substituted succinimide derived from a polyisobutene substituted succinic anhydride or acid and a polyamine, the polyisobutene having a number average molecular weight in the range of about 1500 to about 3000, and in one embodiment about 1800 to about 3000, and the ratio of C═O from the polyisobutene substituted succinic anhydride or acid to N from the polyamine is up to about 1:2, and in one embodiment up to about 1:1.7, and in one embodiment the ratio is up to about 1:1.4.

The acylated nitrogen containing compound may be employed in the lubricating oil composition at a concentration in the range of up to about 20% by weight, and in one embodiment about 1 to about 10 percent by weight, and in one embodiment about 2% to about 8% by weight.

The Mannich Condensate

The Mannich condensates may be products derived from the condensation reaction of a hydrocarbyl-substituted phenol having at least one hydrogen atom bonded to an aromatic carbon (e.g., an alkyl phenol wherein the alkyl group has an average of about 12 to about 400 carbon atoms, and in one embodiment about 30 to about 400 carbon atoms), with at least one aldehyde or aldehyde-producing material (e.g., formaldehyde precursor) and at least one monoamine or polyamine having at least one NH group. The monoamines include primary or secondary monoamines having hydrocarbon substituents of 1 to about 30 carbon atoms or hydroxyl-substituted hydrocarbon substituents of 1 to about 30 carbon atoms. Examples include methyl ethyl amine, methyl octadecyl amines, aniline, diethyl amine, diethanol amine, dipropyl amine, and the like. The polyamines may be any of those described above in the discussion relating to the acylated nitrogen containing compounds.

These condensates may be prepared by reacting about one molar portion of phenolic compound with about 1 to about 2 molar portions of aldehyde and about 1 to about 5 equivalent portions of amino compound (an equivalent of amino compound is its molecular weight divided by the number of ═NH groups present). The conditions under which such condensation reactions are carried out are well known to those skilled in the art.

The Mannich condensate may be employed in the lubricating oil composition at a concentration in the range of up to about 20% by weight, and in one embodiment about 0.5 to about 10% by weight, and in one embodiment about 0.5 to about 5% by weight.

The Alkali or Alkaline Earth Metal Salt Detergent

The alkali metal or alkaline earth metal salt detergent may be an alkali or alkaline earth metal salt of an acidic organic compound. The acidic organic compound may be an organic sulfur acid, carboxylic acid or derivative thereof, phenol or hydrocarbyl substituted saligenin. The acidic organic compound may be a salixarate derivative. These salts may be neutral or overbased. The former contain an amount of metal cation just sufficient to neutralize the acidic groups present in the salt anion; the latter contain an excess of metal cation and are often termed basic, hyperbased or superbased salts. These salts may have a TBN in the range of about 30 to about 500, and in one embodiment about 100 to about 400, and in one embodiment about 200 to about 400, and in one embodiment about 300 to about 400.

The organic sulfur acids may be oil-soluble organic sulfur acids such as sulfonic, sulfamic, thiosulfonic, sulfinic, sulfenic, partial ester sulfuric, sulfurous and thiosulfuric acid. Generally they are salts of aliphatic or aromatic sulfonic acids. The sulfonic acids include the mono- or polynuclear aromatic or cycloaliphatic compounds.

The carboxylic acids include aliphatic, cycloaliphatic, and aromatic mono- and polybasic carboxylic acids such as the naphthenic acids, alkyl- or alkenyl-substituted cyclopentanoic acids, alkyl- or alkenyl-substituted cyclohexanoic acids, alkyl- or alkenyl-substituted aromatic carboxylic acids. The aliphatic acids generally contain at least about 8 carbon atoms, and in one embodiment at least about 12 carbon atoms. Usually they have no more than about 400 carbon atoms. The cycloaliphatic and aliphatic carboxylic acids can be saturated or unsaturated.

A useful group of carboxylic acids are the oil-soluble aromatic carboxylic acids. These acids may be represented by the formula:

$$(R^*)_a—Ar^*(CXXH)_m \quad (II)$$

wherein in Formula (II), R* is an aliphatic hydrocarbyl group of about 4 to about 400 carbon atoms, a is an integer of from one to four, Ar* is a polyvalent aromatic hydrocarbon nucleus of up to about 14 carbon atoms, each X is independently a sulfur or oxygen atom, and m is an integer of from one to four with the proviso that R* and a are such that there is an average of at least about 8 aliphatic carbon atoms provided by the R* groups for each acid molecule. Ar* may be a hydroxyl substituted aromatic nucleus.

A useful group of carboxylic acids are the aliphatic-hydrocarbon substituted salicylic acids wherein each aliphatic hydrocarbon substituent contains an average of at least about 8 carbon atoms, and in one embodiment at least about 16 carbon atoms per substituent, and the acids contain one to three substituents per molecule. A useful aliphatic-hydrocarbon substituted salicylic acid is $C_{16}$–$C_{18}$ alkyl salicylic acid.

A group of carboxylic acid derivatives that are useful are the lactones represented by the formula

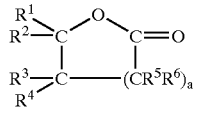

(III)

wherein in Formula (III), $R^1$, $R^2$, $R^3$, $R^4$, $R^5$ and $R^6$ are independently H, hydrocarbyl groups or hydroxy substituted hydrocarbyl groups of from 1 to about 30 carbon atoms, with the proviso that the total number of carbon atoms must be sufficient to render the lactones oil soluble; $R^2$ and $R^3$ can be linked together to form an aliphatic or aromatic ring; and a is a number in the range of zero to 4. A useful lactone can be prepared by reacting an alkyl (e.g., dodecyl)phenol with glyoxylic acid at a molar ratio of about 2:1.

Neutral and basic salts of phenols (generally known as phenates) are also useful in the compositions of this invention and well known to those skilled in the art. The phenols from which these phenates are formed are of the general formula $$(R^*)_a—(Ar^*)—(OH)_m \quad (IV)$$

wherein in Formula (IV), R*, a, Ar*, and m have the same meaning as described hereinabove with reference to Formula (II).

The hydrocarbyl-substituted saligenins may be represented by the formula (V)

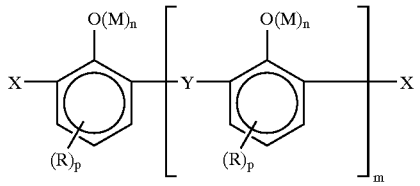

wherein in Formula (V): each X independently is —CHO or —$CH_2OH$; each Y independently is —$CH_2$— or —$CH_2OCH_2$—; wherein the —CHO groups comprise at least about 10 mole percent of the X and Y groups; each M is independently a monovalent of divalent metal ion; each R is independently a hydrocarbyl group containing 1 to about 60 carbon atoms; m is 0 to about 10; n is 0 or 1 provided that when n is 0 the M is replaced with H; and each p is independently 0, 1, 2, or 3; provided that at least one aromatic ring contains an R substituent and that the total number of carbon atoms in all R groups is at least 7; and further provided that if m is 1 or greater, then one of the X groups can be —H. n may have an average value of about 0.1 to about 10, and in one embodiment about 2 to about 9. Each R may contain about 7 to about 28 carbon atoms, and in one embodiment about 9 to about 18 carbon atoms.

The salixarate derivative may be a substantially linear compound comprising at least one unit of formula (VI-A) or formula (VI-B)

VI-A

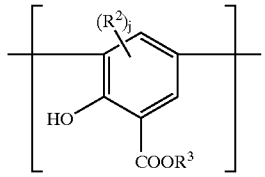

VI-B

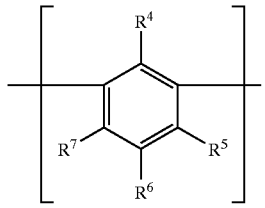

each end of the compound having a terminal group of formula (VI-C) or formula (VI-D):

VI-C

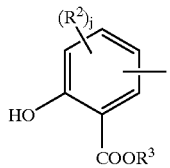

-continued

VI-D

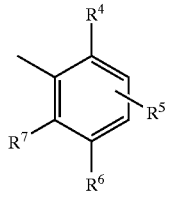

such groups being linked by divalent bridging groups A, which may be the same or different for each linkage; wherein in formulae (VI-A) to (VI-D), $R^3$ is hydrogen or a hydrocarbyl group: $R^2$ is hydroxyl or a hydrocarbyl group and j is 0, 1, or 2; $R^6$ is hydrogen, a hydrocarbyl group, or a hetero-substituted hydrocarbyl group; either $R^4$ is hydroxyl and $R^5$ and $R^7$ are independently either hydrogen, a hydrocarbyl group, or hetero-substituted hydrocarbyl group, or else $R^5$ and $R^7$ are both hydroxyl and $R^4$ is hydrogen, a hydrocarbyl group, or a hetero-substituted hydrocarbyl group; provided that at least one of $R^4$, $R^5$, $R^6$ and $R^7$ is hydrocarbyl containing at least 8 carbon atoms; and wherein the molecules on average contain at least one unit (VI-A) or (VI-C) and at least one of the unit (VI-B) or (VI-D) and the ratio of the total number of units (VI-A) and (VI-C) to the total number of units of (VI-B) and (VI-D) in the composition is about 0.1:1 to about 2:1. The divalent bridging group A, which may be the same or different in each occurrence, includes —$CH_2$— (methylene bridge) and —$CH_2OCH_2$— (ether bridge), either of which may be derived from formaldehyde or a formaldehyde equivalent (e.g., paraform, formalin). Salixarate derivatives and methods of their preparation are described in greater detail in U.S. Pat. No. 6,200,936 and PCT Publication WO 01/56968, which is incorporated herein by reference. It is believed that the salixarate derivatives have a predominantly linear, rather than macrocyclic, structure, although both structures are intended to be encompassed by the term "salixarate."

Mixtures of two or more neutral or basic metal salts of the hereinabove described acidic organic compounds may be used in the lubricating oil compositions.

The alkali and alkaline earth metals that are useful include sodium, potassium, lithium, calcium, strontium and barium, with sodium, lithium and calcium being especially useful.

The alkali or alkaline earth metal containing detergent may be employed in the lubricating oil composition at a concentration in the range of about 0.1 to about 10% by weight, and in one embodiment about 0.2 to about 5% percent by weight, and in one embodiment about 0.3% to about 3% by weight, and in one embodiment about 0.5 to about 2% by weight.

Phosphorus-Containing Metal Salt

The phosphorus-containing acids useful in making the phosphorus-containing metal salts may be represented by the formula (VII)

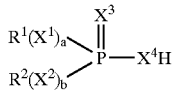

wherein in formula (VII): $X^1$, $X^2$, $X^3$ and $X^4$ are independently oxygen or sulfur, a and b are independently zero or one, and $R^1$ and $R^2$ are independently hydrocarbyl groups. Illustrative examples include: dihydrocarbyl phosphinodithioic acids, S-hydrocarbyl hydrocarbyl phosphonotrithioic acids, O-hydrocarbyl hydrocarbyl phosphinodithioic acids, S,S-dihydrocarbyl phosphorotetrathioic acids, O,S-dihydrocarbyl phosphorotrithioic acids, O,O-dihydrocarbyl phosphorodithioic acids, and the like.

Useful phosphorus-containing acids are phosphorus- and sulfur-containing acids. These include those acids wherein in Formula (VII) at least one $X^3$ or $X^4$ is sulfur, and in one embodiment both $X^3$ and $X^4$ are sulfur, at least one $X^1$ or $X^2$ is oxygen or sulfur, and in one embodiment both $X^1$ and $X^2$ are oxygen, and a and b are each 1. Mixtures of these acids may be employed in accordance with this invention.

$R^1$ and $R^2$ in formula (VII) are independently hydrocarbyl groups that are preferably free from acetylenic unsaturation and usually also from ethylenic unsaturation and in one embodiment have from about 1 to about 50 carbon atoms, and in one embodiment from about 1 to about 30 carbon atoms, and in one embodiment from about 3 to about 18 carbon atoms, and in one embodiment from about 3 to about 8 carbon atoms. Each $R^1$ and $R^2$ can be the same as the other, although they may be different and either or both may be mixtures. Examples of $R^1$ and $R^2$ groups include isopropyl, n-butyl, isobutyl, amyl, 4-methyl-2-pentyl, isooctyl, decyl, dodecyl, tetradecyl, 2-pentenyl, dodecenyl, phenyl, naphthyl, alkylphenyl, alkylnaphthyl, phenylalkyl, naphthylalkyl, alkylphenylalkyl, alkylnaphthylalkyl, and mixtures thereof. Particular examples of useful mixtures include, for example, isopropyl/n-butyl; isopropyl/secondary butyl; isopropyl/4-methyl-2-pentyl; isopropyl/2-ethyl-1-hexyl; isopropyl/isooctyl; isopropyl/decyl; isopropylidodecyl; and isopropyl/tridecyl.

In one embodiment, the phosphorus-containing compound represented by formula (VII) is a compound where a and b are each 1, $X^1$ and $X^2$ are each 0, and $R^1$ and $R^2$ are derived from one or more primary alcohols, one or more secondary alcohols, or a mixture of at least one primary alcohol and at least one secondary alcohol. Examples of useful alcohol mixtures include: isopropyl alcohol and isoamyl alcohol; isopropyl alcohol and isooctyl alcohol; secondary butyl alcohol and isooctyl alcohol; n-butyl alcohol and n-octyl alcohol; n-pentyl alcohol and 2-ethyl-1-hexyl alcohol; isobutyl alcohol and n-hexyl alcohol; isobutyl alcohol and isoamyl alcohol; isopropyl alcohol and 2-methyl-4-pentyl alcohol; isopropyl alcohol and sec-butyl alcohol; isopropyl alcohol and isooctyl alcohol; isopropyl alcohol, n-hexyl alcohol and isooctyl alcohol, etc. These include a mixture of about 40 to about 60 mole % 4-methyl-2-pentyl alcohol and about 60 to about 40 mole % isopropyl alcohol; a mixture of about 40 mole % isooctyl alcohol and about 60 mole % isopropyl alcohol; a mixture of about 40 mole % 2-ethylhexyl alcohol and about 60 mole % isopropyl alcohol; and a mixture of about 35 mole % primary amyl alcohol and about 65 mole % isobutyl alcohol.

The preparation of the metal salts of the phosphorus-containing acids may be effected by reaction with the metal or metal oxide. Simply mixing and heating these two reactants is sufficient to cause the reaction to take place and the resulting product is sufficiently pure for the purposes of this invention. Typically the formation of the salt is carried out in the presence of a diluent such as an alcohol, water or diluent oil. Neutral salts are prepared by reacting one equivalent of metal oxide or hydroxide with one equivalent of the acid. Basic metal salts are prepared by adding an excess of (more than one equivalent) the metal oxide or hydroxide to one equivalent of the phosphorus-containing acid.

The metal salts of the phosphorus-containing acids represented by formula (VII) which are useful include those salts containing Group IA, IIA or IIB metals, aluminum, lead, tin, iron, molybdenum, manganese, cobalt, nickel or bismuth. Zinc is a useful metal. These salts can be neutral salts or overbased salts. Examples of useful metal salts of phosphorus-containing acids, and methods for preparing such salts are found in the prior art such as U.S. Pat. Nos. 4,263,150, 4,289,635; 4,308,154; 4,322,479; 4,417,990; and 4,466,895, and the disclosures of these patents are hereby incorporated by reference. These salts include the Group II metal phosphorodithioates such as zinc dicyclohexylphosphorodithioate, zinc dioctylphosphorodithioate, barium di(heptylphenyl)-phosphorodithioate, cadmium dinonylphosphorodithioate, and the zinc salt of a phosphorodithioic acid produced by the reaction of phosphorus pentasulfide with an equimolar mixture of isopropyl alcohol and n-hexyl alcohol.

The phosphorus-containing metal salt may be employed in the lubricating oil composition at a concentration sufficient to provide a phosphorus concentration in the range of up to about 0.12% by weight, and in one embodiment about 0.03% to about 0.12% percent by weight, and in one embodiment about 0.03% to about 0.10% by weight, and in one embodiment 0.03% to about 0.08%, and in one embodiment about 0.03% to about 0.05% by weight.

Additional Lubricating Oil Additives

The lubricating oil composition may also contain other lubricant additives known in the art. These include, for example, corrosion-inhibiting agents, antioxidants, viscosity modifiers, dispersant viscosity index modifiers, pour point depressants, friction modifiers, antiwear agents other than those discussed above, EP agents other than those discussed above, dispersants other than those discussed above, detergents other than those discussed above, fluidity modifiers, copper passivators, anti-foam agents, etc. The antioxidants include sulfurized olefins, hindered phenols, alkylated diphenyl amines, molybdenum compounds, and the like. Each of the foregoing additives, when used, is used at a functionally effective amount to impart the desired properties to the lubricant. Generally, the concentration of each of these additives, when used, ranges from about 0.001% to about 20% by weight, and in one embodiment about 0.01% to about 10% by weight based on the total weight of the lubricating oil composition.

Concentrates and Diluents

The foregoing lubricating oil additives can be added directly to the base oil to form the lubricating oil composition. In one embodiment, however, one or more of the additives are diluted with a substantially inert, normally liquid organic diluent such as mineral oil, synthetic oil, naphtha, alkylated (e.g., $C_{10}$–$C_{13}$ alkyl)benzene, toluene or xylene to form an additive concentrate. These concentrates usually contain from about 1% to about 99% by weight, and in one embodiment 10% to 90% by weight of such diluent. The concentrates may be added to the base oil to form the lubricating oil composition.

EXAMPLE 1

The lubricating oil compositions disclosed in Table I are tested using the Mitsubishi GDI engine test. The engine is a 1.8 liter, 4-cylinder, direct injection gasoline engine. The following test cycle is repeated 60 times with the duration of the test being 60 hours:

| Stage No. | Duration (mins) | Speed (rpm) | Load (Nm) |
|---|---|---|---|
| 1 | 15 | 2000 | 40 |
| 2 | 15 | 2250 | 50 |
| 3 | 15 | 2500 | 50 |
| 4 | 10 | 3000 | 100 |
| 5 | 5 | idle | minimum |

At the end of the test, the engine is stripped, and the inlet valves are weighed with and without deposits to determine deposit weight. The results are indicated in Table I. Examples 1–3 are within the scope of the invention. Example C-1 is provided for comparative purposes.

TABLE I

| | 1 | 2 | 3 | C-1 |
|---|---|---|---|---|
| Base Oil: | | | | |
| Polyalphaolefin oil having viscosity at 100° C. of 6 cSt | 59.70 | 60.90 | 60.90 | — |
| Ester A (synthetic ester oil derived from trimethyol propane and $C_8$–$C_{10}$ monocarboxylic acids having viscosity of 4.5 cSt at 100° C.) | 20.00 | 20.00 | 20.00 | — |
| Group I oil having viscosity at 100° C. of 4.9–5.1 cSt, a saturates content of 77–82%, and sulfur content of 0.3–0.4 wt % | — | — | — | 10.00 |
| Group III oil having viscosity at 100° C. of 4.2–4.4 cSt, saturates content of 100%, and sulfur content <0.001 wt % | — | — | — | 68.90 |
| Viscosity modifier | 5.00 | 5.00 | 5.00 | 5.80 |
| Pour point depressant | 0.20 | 0.20 | 0.20 | 0.20 |
| Dispersant: succinimide derived from polyisobutene (Mn = 2000) substituted succinic anhydride and polyethylene amines dispersed in oil, CO:N ratio = 1.1:1; PIB:MAA ratio = 1:1.5 (40% diluent oil) | 7.3 | — | 7.3 | — |
| Dispersant: succinimide derived from polyisobutene (Mn = 2000) substituted succinic anhydride and polyethylene amines dispersed in oil, CO:N ratio = 1.2:1; PIB:MAA ratio = 1:1.9 (56% diluent oil) | — | 5.5 | — | 5.5 |
| Dispersant: succinimide derived from polyisobutene (Mn = 1000) substituted succinic anhydride and polyethylene amines dispersed in oil, CO:N ratio = 4:3; PIB:MAA = 91:9 (40% diluent oil) | — | 1.8 | — | 1.8 |
| Detergent: calcium sulfonate dispersed in oil | 1.99 | 1.2 | 1.2 | 1.99 |
| Detergent: calcium phenate dispersed in oil | 1.0 | 0.6 | 0.6 | 1.0 |
| EP/antiwear additive: zinc dialkyl dithiophosphate | 0.98 | 0.98 | 0.98 | 0.98 |
| Antioxidant: alkylated diphenyl amine | 0.8 | 0.8 | 0.8 | 0.8 |
| Antioxidant: sulfurized olefin | 0.45 | 0.45 | 0.45 | 0.45 |
| Antioxidant: 2,6-di-t-butyl-4-dodecyl phenol | 0.78 | 0.78 | 0.78 | 0.78 |
| Friction modifier | 1.2 | 1.2 | 1.2 | 1.2 |
| Diluent oil | 0.60 | 0.59 | 0.59 | 0.60 |
| SAE Viscosity Grade | 5W30 | 5W30 | 5W30 | 5W30 |
| Ash content (ASTM D874-96) | 1.2 | 0.8 | 0.8 | 1.2 |
| Total CCD Deposits (g) | 8.591 | 8.294 | 8.851 | 11.253 |
| Total IVD Deposits (g) | 0.835 | 1.157 | 1.170 | 1.398 |

EXAMPLE 2

The lubricating oil compositions disclosed is Table II are tested using the VW FSI engine test. The engine is a 1.1 liter, 4-cylinder, direct injection gasoline engine. The test cycle is the Braunschweig cycle. The test cycle has a duration of 10 minutes and is repeated 600 times. The duration of the test is 100 hours. At the end of the test, the engine is stripped, and the inlet values are weighed with and without deposits to determine deposit weight. Examples 4–6 are within the scope of the invention. Example C-2 is provided for purposes of comparison. The results are indicated in Table II.

TABLE II

| | C-2 | 4 | 5 | 6 |
|---|---|---|---|---|
| Base Oil: | | | | |
| Polyalphaolefin oil having viscosity @ 100° C. of 4 cSt | 65.70 | 23.58 | 24.83 | 24.83 |
| Ester A | 10.00 | — | — | — |
| Ester B (synthetic ester oil derived from $C_{18}$ monocarboxylic acid and $C_{20}$ alcohol having a viscosity @ 100° C. of 5.5 cSt) | — | 50.00 | 50.00 | 50.00 |
| Viscosity modifier | 6.50 | 10.00 | 10.00 | 10.00 |
| Dispersant: succinimide derived from polyisobutene (Mn = 1000) substituted succinic anhydride and polyethylene amines, dispersed in oil (40% diluent oil) | 1.00 | 1.00 | — | — |
| Dispersant: succinimide derived from polyisobutene (Mn = 1000) substituted succinic anhydride and polyethylene amines, dispersed in oil, CO:N ratio = 1:1–1.1 (30% diluent oil) | 6.99 | 6.99 | 8.99 | 6.99 |
| Dispersant: Mannich condensate derived from polyisobutene (Mn = 1000) substituted phenol, paraformaldelyde and ethylene diamine dispersed in naphtha solvent (33% solvent) | — | — | — | 2.00 |
| Detergent: calcium sulfonate dispersed in oil | 2.89 | 2.79 | 2.09 | 2.09 |
| Detergent: calcium phenate dispersed in oil | 2.04 | 2.04 | 1.00 | 1.00 |
| EP/antiwear additive: zinc dialkyl dithiophosphate | 1.19 | 1.19 | 1.19 | 1.19 |
| Antioxidant: sulfurized olefin | 0.30 | 0.30 | 0.30 | 0.30 |
| Antioxidant: alkylated diphenyl amine | 0.35 | 0.35 | 0.35 | 0.35 |
| Friction modifier | 0.10 | 0.10 | 0.10 | 0.10 |
| Antifoam additive | 0.01 | 0.01 | 0.01 | 0.01 |
| Diluent oil | 3.03 | 1.65 | 1.14 | 1.14 |
| SAE Viscosity Grade | 0W30 | 0W30 | 0W30 | 0W30 |
| Ash content (ASTM D874-96) | 1.5 | 1.2 | 1.2 | 1.2 |
| Normalized intake valve deposits | 100 | 57.7 | 63.3 | 67.1 |

While the invention has been explained in relation to certain embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A method of reducing intake valve deposits in a direct injection engine, the method comprising lubricating the engine with a lubricating oil composition comprising a base oil mixture, the base oil mixture comprising (i) a Group III oil, a Group IV oil, or a mixture thereof, in combination with (ii) a synthetic ester oil, the weight ratio of (i) to (ii) being from about 0.2:1 to about 6:1.

2. The method of claim 1 wherein the direct injection engine is a spark ignition engine.

3. The method of claim 1 wherein the direct injection engine is a compression ignition engine.

4. The method of claim 1 wherein the lubricating oil composition has a viscosity of up to about 16.3 cSt at 100° C.

5. The method of claim 1 wherein the lubricating oil composition has an SAE Viscosity Grade of 5, 10, 20, 30, 40, 50, 60, 0W-20, 0W-30, 0W-40, 0W-50, 0W-60, 5W-20, 5W-30, 5W-40, 5W-50, 5W-60, 10W-20, 10W-30, 10W-40, 10W-50, 15W-20, 15W-30, 15W-40, 15W-50, 20W-20, 20W-30, 20W-40 or 20W-50.

6. The method of claim 1 wherein the Group III oil has a saturates content of at least about 95% by weight and a sulfur content of up to about 0.02% by weight.

7. The method of claim 1 wherein the Group IV oil is a polyalphaolefin oil derived from one or more monomers having about 4 to about 30 carbon atoms.

8. The method of claim 1 wherein the Group IV oil is a polyalphaolefin oil having a viscosity of about 2 to about 15 cSt at 100° C.

9. The method of claim 1 wherein the synthetic ester oil is derived from a monocarboxylic acid or a dicarboxylic acid and an alcohol or a polyol.

10. The method of claim 1 wherein the synthetic ester oil comprises dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, 2-ethylhexyl diester of linoleic acid dimer, an ester formed by reacting one mole of sebacic acid with two moles of tetraethylene glycol and two moles of 2-ethylhexanoic acid, or a mixture of two or more thereof.

11. The method of claim 1 wherein the synthetic ester oil derived from a monocarboxylic acid of about 8 to about 10 carbon atoms and trimethyol propane.

12. The method of claim 1 wherein the synthetic ester oil is derived from a monocarboxylic acid of about 12 to about 20 carbon atoms and an alcohol of about 12 to about 20 carbon atoms.

13. The method of claim 1 wherein the lubricating oil composition further comprises of an acylated nitrogen-containing compound having a substituent of at least about 10 aliphatic carbon atoms.

14. The method of claim 13 wherein the acylated nitrogen-containing compound is derived from a carboxylic acylating agent and at least one amino compound containing at least one —NH— group, the acylating agent being linked to the amino compound through an imido, amido, amidine or salt linkage.

15. The method of claim 14 wherein the amino compound is an alkylenepolyamine represented by the formula:

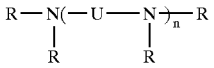

wherein U is an alkylene group of from about 2 to about 10 carbon atoms; each R is independently a hydrogen atom, a hydrocarbyl group, a hydroxy-substituted hydrocarbyl group, or an amine-substituted hydrocarbyl group containing up to about carbon atoms, with the proviso that at least one R is a hydrogen atom; and n is 1 to about 14.

16. The method of claim 13 wherein the acylated nitrogen containing compound is a polyisobutene substituted succinimide, the ratio of succinic groups to equivalent weights of polyisobutene being in the range of about 0.6:1 to about 1.8:1.

17. The method of claim 13 wherein the acylated nitrogen containing compound is a polyisobutene substituted succinimide, the ratio of succinic groups to equivalent weights of polyisobutene being in the range of about 0.9:1 to about 1.5:1.

18. The method of claim 13 wherein the acylated nitrogen containing compound is a polyisobutene substituted succinimide, the polyisobutene substituted succinimide being derived from a polyisobutene substituted succinic anhydride or acid and at least one polyamine, the ratio of C═O from the polyisobutene substituted succinic anhydride to N from the polyamine being up to about 1.18:1.

19. The method of claim 13 wherein the acylated nitrogen containing compound is a polyisobutene substituted succinimide, the polyisobutene substituted succinimide being derived from a polyisobutene substituted succinic anhydride or acid and at least one polyamine, the ratio of C═O from the polyisobutene substituted succinic anhydride to N from the polyamine being up to about 1.1:1.

20. The method of claim 13 wherein the acylated nitrogen containing compound is a polyisobutene substituted succinimide, the polyisobutene substituted succinimide being derived from a polyisobutene substituted succinic anhydride or acid and at least one polyamine, the polyisobutene substituent having a number average molecular weight in the range of about 1500 to about 3000, the ratio of C═O from the polyisobutene substituted succinic anhydride or acid to N from the polyamine being up to about 1:2.

21. The method of claim 13 wherein the acylated nitrogen-containing compound is a polyisobutene substituted succinimide containing at least about 50 aliphatic carbon atoms in the polyisobutene group.

22. The method of claim 1 wherein the lubricating oil composition further comprises a Mannich condensate.

23. The method of claim 1 wherein the lubricating oil composition further comprises a metal salt of a compound represented by the formula

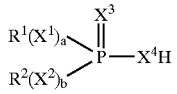

wherein $X^1$, $X^2$ and $X^3$ and $X^4$ are independently O or S, a and b are independently zero or 1, and $R^1$ and $R^2$ are independently hydrocarbyl groups.

24. The method of claim 1 wherein the lubricating oil composition further comprises an alkali or alkaline earth metal salt detergent.

25. The method of claim 1 wherein the lubricating oil composition further comprises at least one detergent, dispersant, corrosion-inhibiting agent, antioxidant, viscosity improving agent, EP agent, pour point depressant, friction modifier, fluidity modifier, anti-foam agent, or mixture of two or more thereof.

26. The method of claim 1 wherein the lubricating oil composition has a sulfated ash content of up to about 1.8% by weight.

27. A method of reducing intake valve deposits in a direct injection engine, the method comprising lubricating the engine with a lubricating oil composition comprising:

a base oil mixture comprising a polyalphaolefin oil and a synthetic ester oil, the weight ratio of the polyalphaolefin oil to the synthetic ester oil being about 0.2:1 to about 6:1; and a polyisobutene substituted succinimide, the polyisobutene substituted succinimide being derived from a polyisobutene substituted succinic anhydride or acid and at least one polyamine, the ratio of succinic groups to equivalent weights of polyisobutene being in the range of about 0.9:1 to about 1.8:1, the number average molecular weight of the polyisobutene being in the range of about 750 to about 3000.

28. A method of reducing intake valve deposits in a direct injection engine, the method comprising lubricating the engine with a lubricating oil composition comprising:

a base oil mixture comprising a polyalphaolefin oil and a synthetic ester oil, the weight ratio of the polyalphaolefin oil to the synthetic ester oil being about 0.2:1 to about 6:1; and a polyisobutene substituted succinimide, the polyisobutene substituted succinimide being derived from a polyisobutene substituted succinic anhydride or acid and at least one polyamine, the mole ratio of C═O from the polyisobutene substituted succinic anhydride to N from the polyamine being up to about 1.18:1, the number average molecular weight of the polyisobutene being in the range of about 750 to about 3000.

* * * * *